US009433245B2

(12) United States Patent
Elsmo

(10) Patent No.: US 9,433,245 B2
(45) Date of Patent: Sep. 6, 2016

(54) WEARABLE COVER

(71) Applicant: Alan Elsmo, Northbrook, IL (US)

(72) Inventor: Alan Elsmo, Northbrook, IL (US)

( * ) Notice: Subject to any disclaimer, the term of this patent is extended or adjusted under 35 U.S.C. 154(b) by 252 days.

(21) Appl. No.: 13/949,466

(22) Filed: Jul. 24, 2013

(65) Prior Publication Data

US 2015/0026863 A1 Jan. 29, 2015

(51) Int. Cl.
*A41D 3/08* (2006.01)
*A47G 9/06* (2006.01)

(52) U.S. Cl.
CPC ..... *A41D 3/08* (2013.01); *A47G 9/066* (2013.01); *A41D 2200/20* (2013.01)

(58) Field of Classification Search
CPC ..... A41D 3/00; A41D 3/08; A41D 3/02; A41D 19/0041; A41D 2200/20; A41D 200/20; A41D 13/00; A41D 13/0012; A41D 1/00; A41D 10/00; A41D 15/04; A41D 1/02; A42B 17/04; A42B 1/006; A42B 1/06; A42B 1/066; A42B 1/067; A42B 1/206; A42B 1/048; A42B 1/041; A42B 1/00; A42B 3/0406; A42B 1/002
USPC ..... 2/85, 80, 83, 69, 69.5, 93, 88, 84, 87, 2/171, 209, 209.13
See application file for complete search history.

(56) References Cited

U.S. PATENT DOCUMENTS

| | | | | |
|---|---|---|---|---|
| 3,837,006 | A * | 9/1974 | Laseman | 2/89 |
| 4,764,985 | A | 8/1988 | Wade | |
| 5,560,043 | A * | 10/1996 | Armstrong | 2/69.5 |
| 5,815,833 | A * | 10/1998 | Kuo | 2/69.5 |
| 7,296,302 | B2 | 11/2007 | DeLorenzo et al. | |
| 2006/0260019 | A1 | 11/2006 | Kraus et al. | |
| 2008/0307555 | A1 | 12/2008 | Barreiro | |
| 2010/0146680 | A1 | 6/2010 | Cuoco | |
| 2010/0218299 | A1 | 9/2010 | Damir | |
| 2010/0313323 | A1 | 12/2010 | Tennelle | |
| 2012/0317694 | A1 * | 12/2012 | Block et al. | 2/84 |

OTHER PUBLICATIONS

"Hudson Blanket Capote" ("Blizzard survival sleeping bag)." Date Unknown.
Coat (top photo) and "Toddler cape with slits" (bottom photo). Date Unknown.
"Adult turtleneck cape." Date Unknown.
"Turtleneck with hood." Date Unknown.
International Search Report and Written Opinion from PCT/US2014/047757 mailed Feb. 4, 2015.

* cited by examiner

*Primary Examiner* — Gloria Hale
(74) *Attorney, Agent, or Firm* — Polsinelli PC; Bradley W. Crawford

(57) ABSTRACT

A wearable cover is disclosed for covering a body of a user, the wearable cover comprising a main portion configured to cover a torso of the user's body. The main portion has an opening for enabling a head of the user's body to extend through the main portion and a collar attached to the main portion configured to cover a neck of the user's body and a hat attached to the collar configured to cover a portion of the head.

27 Claims, 7 Drawing Sheets

FIG. 5
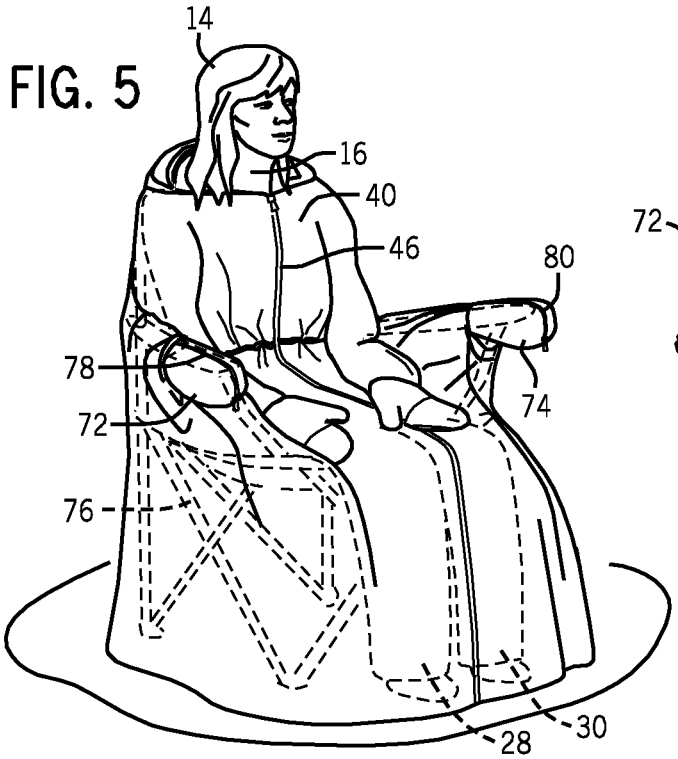
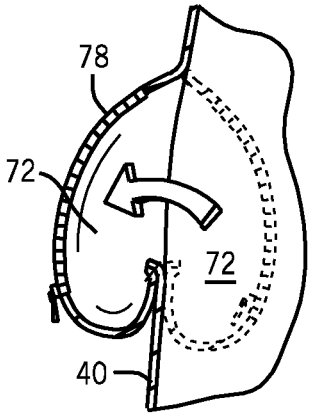
FIG. 6
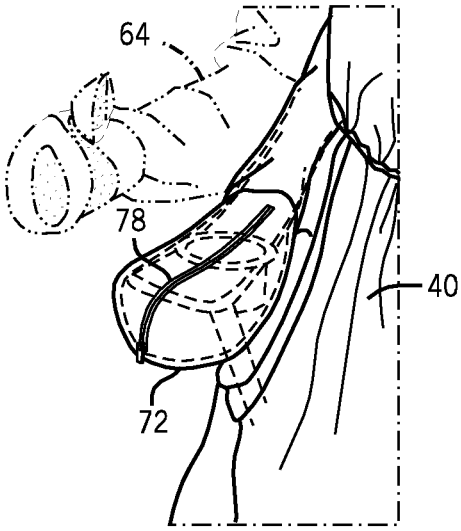
FIG. 7
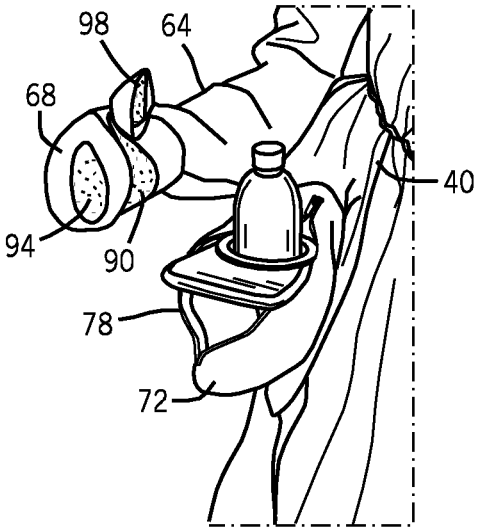
FIG. 8

FIG. 9
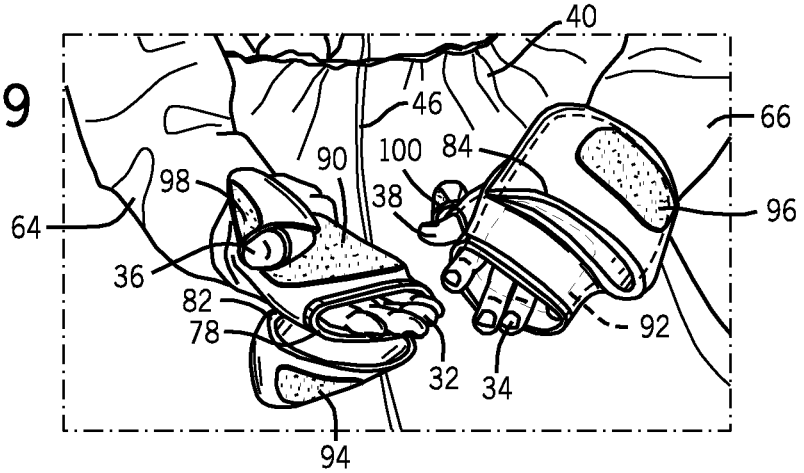
FIG. 10
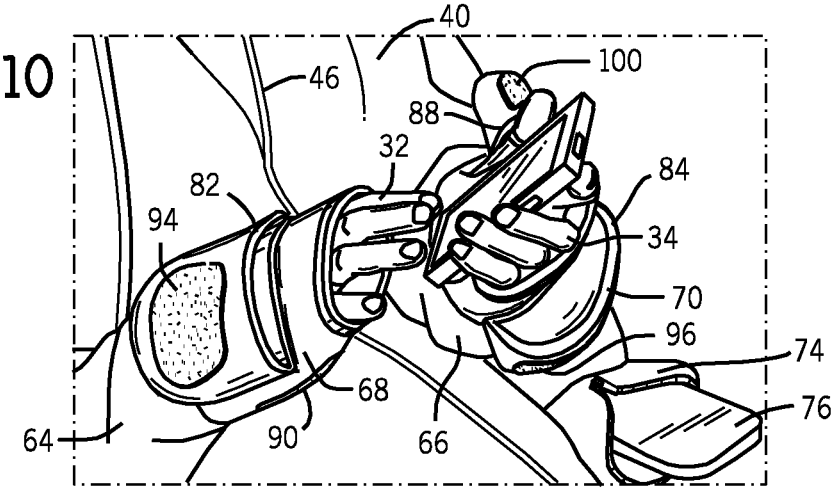
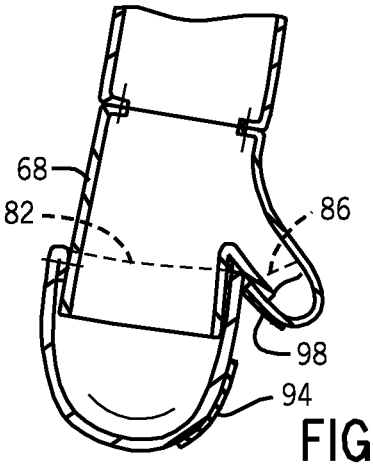
FIG. 11
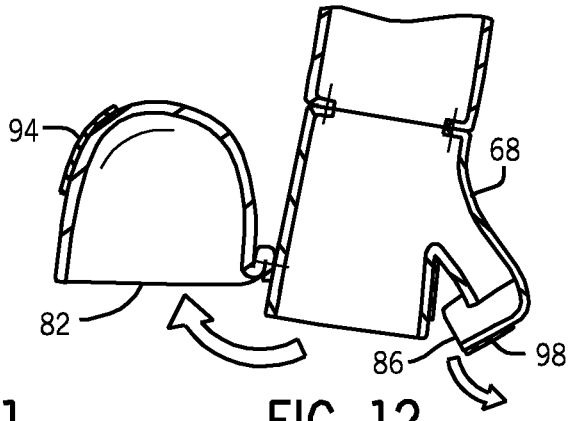
FIG. 12

WEARABLE COVER

FIELD OF THE INVENTION

The present invention relates to a wearable cover for covering a user's body.

BACKGROUND OF THE INVENTION

Users spend considerable time outdoors watching their favorite sporting, theater, musical and other events. Examples of these events include soccer, baseball, music festivals, bonfires, skating, cycling, marathons, camping, fishing, barbeques and football games. Unfortunately, the cold weather can make attendance quite uncomfortable. Weather conditions may consistently be unbearable (e.g., 20 degrees with high winds) or such conditions may vary throughout an event. In one example, a user may be at a soccer event sitting on a foldable sports chair watching his/her child play. In another example, a user may be in a stadium seat watching a football game. In both of these examples, the weather and temperature may change instantly from a sunny 60 degree day to a blustery 40 degrees with high winds and/or rain. Users will seek better solutions to keep warm, dry and sheltered from the wind to be best prepared for the weather and its changes.

Users have a variety of products that they currently use to keep warm and shield themselves from the weather. Examples of these products or items include sweaters, scarves, coats, blankets, hats, gloves and umbrellas to name a few. A particular user may use one or more of these items separately or together in an attempt to maintain warmth or shield from the elements. For example, a user may wrap his/her body in a large king-sized fleece blanket over a full-length coat to stay warm.

Unfortunately, these items neither adequately provide proper insulation (e.g., from wind and other elements) nor allow a user to regulate temperature as it varies throughout an event. These products can have additional disadvantages. Once the products are layered or fixed in place, a user will have great difficulty accessing a beverage, food, a phone or other items without dislodging such products. Further, in the event a user needs to retrieve additional food or use the lavatory, the user must remove each item, travel to and from the desired location and then re-layer or re-fit all of these items to maintain warmth again. In addition, these items may dislodge or become disheveled when the user moves either in a seated or standing position as a spectator would.

It would thus be advantageous to provide a product that will overcome the problems described above.

SUMMARY OF THE INVENTION

A wearable cover is disclosed for covering a user's body. The wearable cover is a consumer wearable that may be used by a user to endure various climate conditions.

In accordance with an embodiment of the present invention, a wearable cover is disclosed for covering a body of a user, the wearable cover comprising: a main portion configured to cover a torso of the user's body, the main portion having an opening for enabling a head of the user's body to extend through the main portion; and a collar attached to the main portion configured to cover a neck of the user's body and a hat attached to the collar configured to cover a portion of the head.

In accordance with an embodiment of the present invention, a wearable cover is disclosed for covering a body of a user, the wearable cover comprising: a main portion configured to cover a torso of the user's body, the main portion having a first opening for enabling a head of the user's body to extend through the main portion and a second opening configured to enable an arm of the user's body to extend through the main portion; a sleeve attached to the main portion over the opening, the sleeve configured to cover an arm of the user's body; and a hand covering attached the sleeve, the hand covering configured to cover the hand of a user.

In accordance with an embodiment of the present invention, a wearable cover disclosed for covering a body of a user, the wearable cover comprising: a main portion configured to cover a torso of the user's body, the main portion having an opening for enabling a head of the user's body to extend through the main portion; and a plurality of portions including (1) a collar attached to the main portion configured to cover a portion of the user's body and (2) a hat attached to the collar configured to cover a portion of the head.

BRIEF DESCRIPTION OF THE DRAWINGS

The embodiments of the present invention are described in detail below with reference to the following drawings, which form a part of this application.

FIG. 5 depicts a perspective view of the wearable cover in FIG. 1 on a user in a seated position.

FIG. 6 depicts a cross-sectional view of the wearable cover in FIG. 1, wherein a pocket is shown turned-out, in its closed form.

FIG. 7 depicts a detailed perspective view of the wearable cover in FIG. 5, wherein the pocket is shown turned out in closed form, covering an arm of a chair.

FIG. 8 depicts a detailed perspective view of the wearable cover in FIG. 5, wherein the pocket is shown in unzipped open form.

FIG. 9 depicts a detailed perspective view of the wearable cover in FIG. 1, wherein the hand coverings are shown exposing a user's fingers and thumbs.

FIG. 10 depicts a detailed perspective view of the wearable cover in FIG. 1, wherein the hand coverings are shown in open form, exposing a user's fingers and thumbs during use.

FIG. 11 depicts a cross-sectional view of a mitten of the wearable cover in FIG. 1 shown in a closed form.

FIG. 12 depicts a cross-sectional view of a mitten of the wearable cover in FIG. 1 shown in an open form.

DETAILED DESCRIPTION OF THE INVENTION

Figure 1:
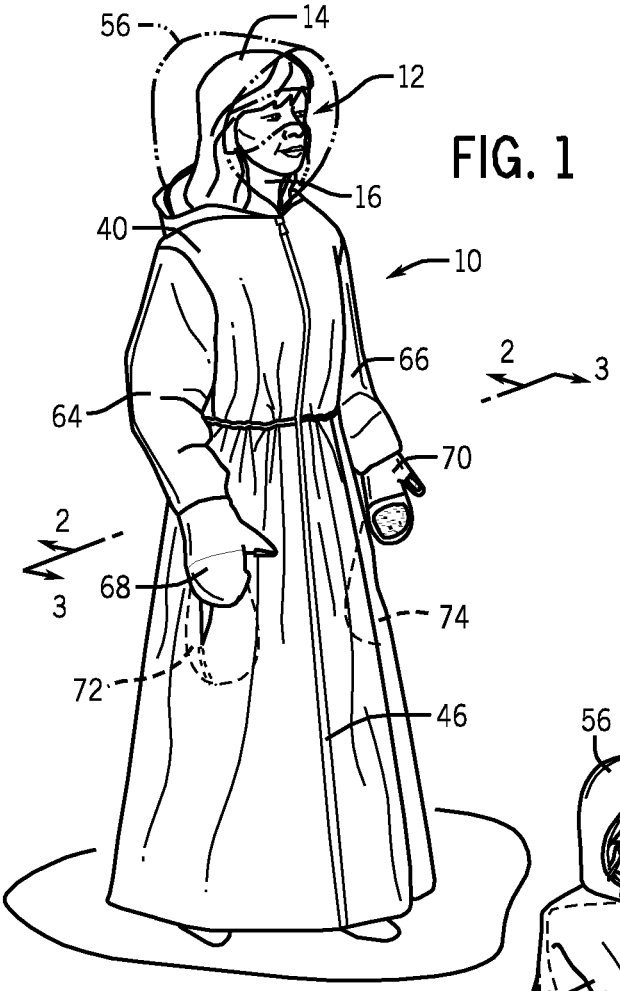
FIG. 1 depicts a perspective view of the wearable cover on a user in a standing position in accordance with an embodiment of the present invention.
Figure 3:
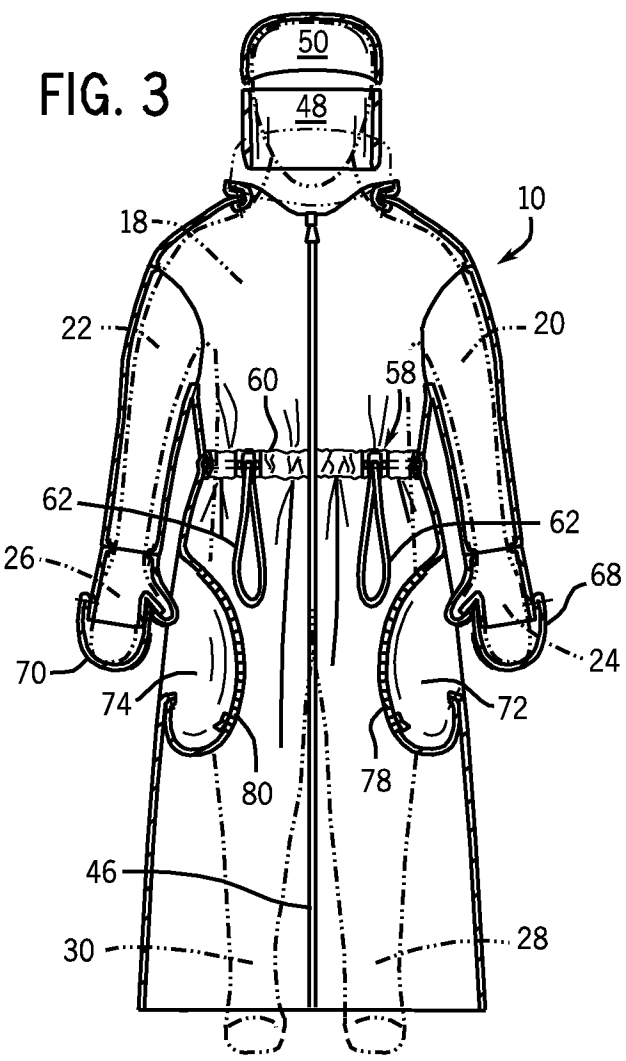
FIG. 3 depicts a cross-sectional inside front view of the wearable cover shown in FIG. 1 taken along line 3-3.
Figure 2:
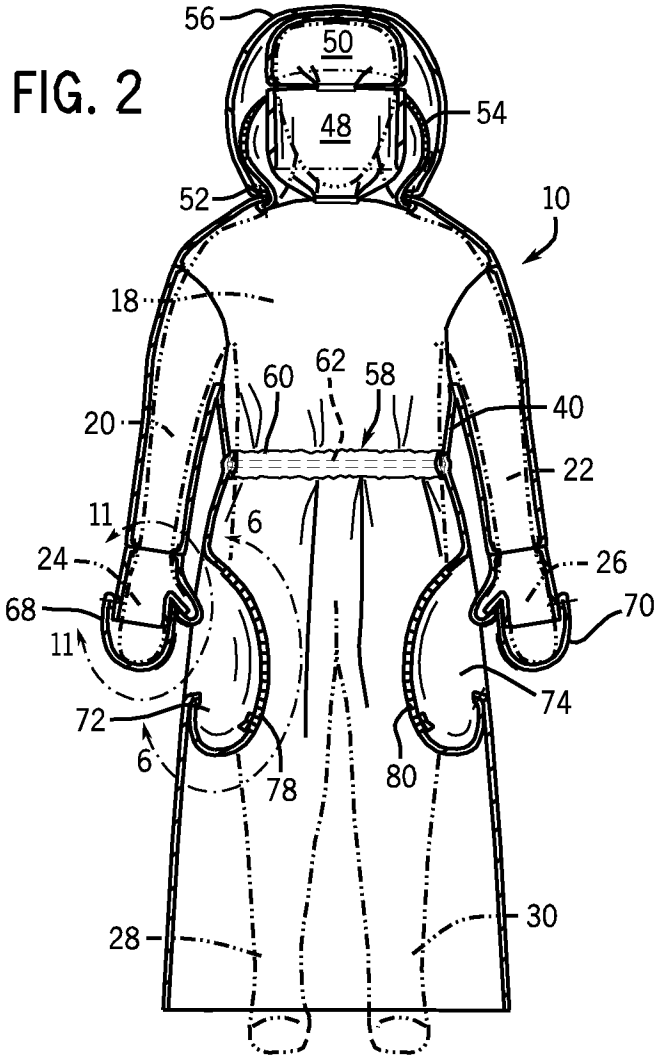
FIG. 2 depicts a cross-sectional inside rear view of the wearable cover shown in FIG. 1 taken along line 2-2.

FIG. 1 depicts a perspective view of wearable cover 10 on user's body 12 in a standing position in accordance with an embodiment of the present invention. FIG. 2 depicts a cross-sectional inside rear view of wearable cover 10 shown in FIG. 1 taken along line 2-2 in FIG. 1 (without user's body 12). FIG. 3 depicts a cross-sectional inside front view of wearable cover 10 shown in FIG. 3 taken along line 3-3 in FIG. 1 (without user' body 12). Wearable cover 10 is used for covering the user's body 12. User's body 12 includes head 14, neck 16, torso 18, arms 20, 22, hands 24, 26 and legs 28, 30. Hands 32, 34 include, fingers 32, 34 and thumbs 36, 38 as known to those skilled in the art. The body parts are shown throughout the figures. Wearable cover 10 generally drapes over user's body 12 in full as described in detail below. Wearable cover 12 is preferably constructed of flexible, stretchable and/or adjustable materials such as variations of fleece and/or waterproof/water-resistant fabrics as described below, but those skilled in the art know that other fabric variations may be used. The user shown in these figures is a woman, but those skilled in the art know that user may be a man, infant or a user's pet such as a dog.

Wearable cover 10 generally defines a layer that envelops user's body 12 when fully deployed, or wearable cover 10 envelops user's body 12 in part when partially deployed as described below. As seen in the figures, wearable cover 10 includes main portion 40 that is configured to cover torso 18 and legs 28, 30. Main portion 40 also includes (1) opening 42 that enables head 14 to protrude through main portion 40 and (2) slit 44 that extends from opening 42 toward to the bottom of main portion 40 adjacent a user's feet. Slit 44 enables user egress and ingress. Main portion 40 also includes a closure device such as zipper 46 that is used to open and close slit 44. Zipper 46 is a full-length front zipper that includes the grasping tab and teeth that extend along the edges of main portion 40 that defines slit 44, as known to those skilled in the art.

Wearable cover 10 further includes a plurality of other portions including collar 48, hat 50 and pouch 52. Pouch 52 is attached to (1) the rear of main portion 40 (adjacent neck 16) along the border of opening 42 of main portion 40 and (2) hood 56 (described below). Collar 48 is also attached to and between the ends of pouch 52 (opposite to zipper 54). Collar 48 is configured to cover neck 16 alone, neck 16 and a lower portion of a user's face/head 14 or the lower portion of the user's face/head 14 alone. Functionally, collar 48 acts like a turtle neck as known to those skilled in the art, expanding and compressing as needed to cover parts of the user. In practice, collar 48 deploys over head 14 and settles in place over neck 16 and/or head 14 (face). Hat 50 is attached to the edge of collar 48 in the rear of main portion 42 (adjacent the rear of the head). Collar 48, hat 50 and pouch 52 are preferably attached as described via stitching but those skilled in the art know that there are other ways in which collar 48, hat 50 and pouch 52 may be attached. Collar 48 and hat 50 are configured to be folded (i.e., compressed) and fitted within pouch 52. Pouch 52 also has a closure device along the edge thereof in the form of zipper 54. As known to those skilled in art, zipper 54 includes the grasping tab and teeth along the edge of main portion 40 that defines slit 44. Zipper 54 functions to open and close pouch 52 to access and deploy collar 48 and hat 50.

Wearable cover 10 has additional portions including hood 56 which functions as known to those skilled in the art. The distal end or base of hood 56 is attached between the main portion 40 and outer end of pouch 52, behind and to the rear of it. This is illustrated best in FIGS. 15-20. Hood 56 will drape free down the back of user body 12 as known to those skilled in the art. (Hood 56 may be used with or without use of collar 48 or hat 56.) Hood 56 will envelop pouch 52 when hood 56 is fully deployed on head 14 of user's body 12. Alternatively, hood 56 may be attached to inside of pouch 52, but it may also be configured to be compressed and fitted within pouch 52 as known to those skilled in the art.

Wearable cover 10 includes band 58 (as another portion of wearable cover 10) along the waist of user's body 12. In the embodiment in the figures, band 58 consists of a bore 60 within main portion 40 that extends around the waist area and drawstring 62 within bore 60. Drawstring 62 is constructed in a looping configuration as shown and known to those skilled in the art. Adjustable clamps (shown in FIGS. 2 and 3) are used to adjust band 58 to contract or expand main portion 40 around the waist area as desired. These clamps include a push tab to release and allow the user to adjust the waist drawstring 62 as known to those skilled in the art. While a band, drawstring and clamps are incorporated in this embodiment, those skilled in the art know that other embodiments exist for adjusting the waistband. For example, a single drawstring may be tied together at its end (without using the clamp.) In addition, band 58 may have an elastic construction as known to those skilled in the art. In this embodiment, band 58 may be loosened as desired to allow more air between wearable cover 10 and user's body 12 to function as a buffer layer for warmth and user movement. Wearable cover 10 further includes sleeves and mittens (hand coverings) as disclosed in more detail below.

Now, main portion 40 includes two openings configured to enable arms 20, 22 of user's body 12 to extend through main portion 40. Wearable cover 10 further includes additional portions such as sleeves 64, 66 and mittens 68, 70. Sleeves 64, 66 are attached to main portion 40 over the openings. Sleeves 64, 66 are configured to cover arms 20, 22 of user's body 12 as known to those skilled in the art. Mittens 68, 70 are attached to sleeves 64, 66, respectively. Mittens 68, 70 are one form of hand coverings configured to cover user's hands 24, 26, but those skilled in the art know that other hand coverings may be used such as gloves. The attachment mechanisms between sleeves 64, 66 and main portion 40 and between sleeves 64, 66 and mittens 68, 70 are preferably stitching. However, mittens 68, 70, sleeves 64, 66 and main portion 40 may be constructed as two components or as one integral component. Mittens 68, 70 are discussed again in more detail below.

Main portion 40 includes pockets 72, 74 located near the waist area thereof. Pockets 72, 74 are configured to receive mittens 68, 70 (hands 24, 26) as known to those skilled in the art. In addition, pockets 72, 74 are also configured to receive an armrest of chair 76 from inside main portion 40 when pockets 72, 74 are turned-out, i.e., reversed or pushed outside of main portion 40. In this configuration, pockets 72, 74 each define an opening configured or sized to enable an armrest of chair 76 to extend through the main portion 40. This is described in more detail below. As part of main portion 40, inside pockets 72, 74, zippers 78, 80 are incorporated for selectively opening and closing the pockets. While zippers 78, 80 are fully zipped, pockets 72, 74 function as pockets as known to those skilled in the art. The chair in the figures is a transportable folding chair but those skilled in the art know that the chair may be of any type including a fixed or folding stadium chair.

Figure 4:
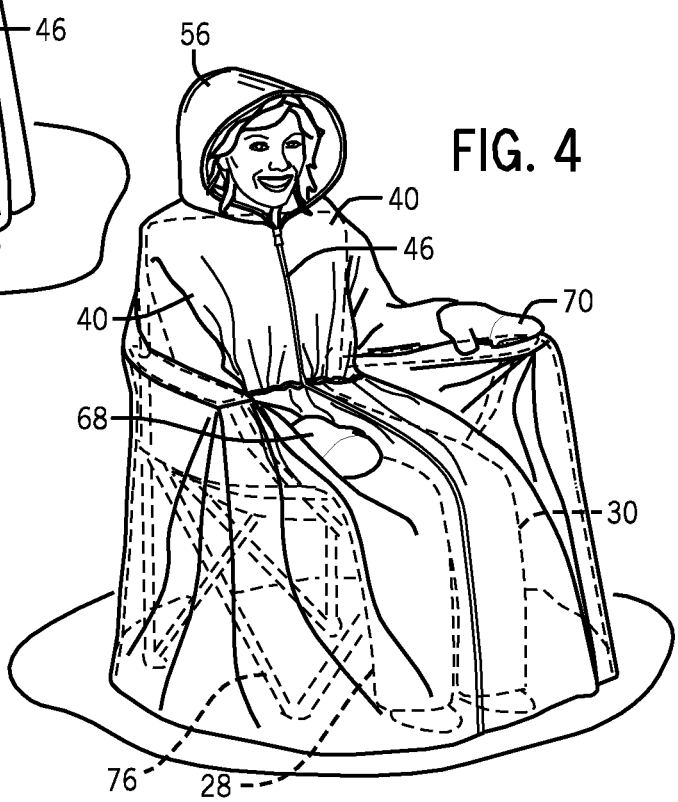
FIG. 4 depicts a perspective view of the wearable cover of FIG. 1 on a user in a seated position.

Turning now to FIG. 4, it depicts a perspective view of the wearable cover 10 of FIG. 1 on a user in a seated position. In this configuration, main portion 40 is able to expand around chair 76 in a tent like fashion whereby an air layer is formed between user's body 12 and main portion 40. That is, wearable cover 10 is configured to drape completely over chair 76 creating an air pocket or layer that provides additional warmth in cold climates. Also in this configuration, hood 56 is fully deployed on head 14 of user's body 12, but collar 48 and hat 50 are not. Further, zippers 78, 80 are fully zipped to close pockets 72, 74 (whereby the arm rests do not extend into pockets 72, 74 or protrude through the openings in pockets 72, 74).

FIG. 5 depicts a perspective view of the wearable 10 cover in FIG. 1 on a user in a seated position as well. In this configuration, pockets 72, 74 are reversed, i.e., pushed outside of main portion 40, and the armrests extend into pockets 72, 74. However, zippers 78, 80 are fully zipped.

FIG. 6 depicts a cross-sectional view of the wearable cover in FIG. 1, wherein a pocket is shown turned-out, in its closed form. On the other hand, FIG. 7 depicts a detailed perspective view of the wearable cover in FIG. 5, wherein the pocket is shown turned out in closed form, covering an armrest of chair 76. FIG. 8 depicts a detailed perspective view of the wearable cover in FIG. 5, wherein the pocket is shown in open form (unzipped configuration). In this configuration, the user may grip and grasp a bottle or beverage situated within the beverage holder in the armrest as shown in FIG. 8 and described below.

Reference is now made to FIGS. 9-12. FIG. 9 depicts a detailed perspective view of wearable cover 10 in FIG. 1, wherein mittens 68, 70 (hand coverings) are shown exposing fingers 32, 34 and thumbs 36, 38. Mittens 68, 70 (the hand coverings) include slits 78, 80 configured to enable a portion of the hand (fingers) to extend through mittens 68, 70 as shown. That is, a portion of each mitten 68, 70, is folded back along the edges defining slits 82, 84 exposing fingers 32, 34. Mittens 68, 70 further include slits 86, 88 to enable the thumbs 36, 38 of hands 24, 26 to extend through the mittens. That is, a portion of each mitten 68, 70, is folded back along the edges defining slits 86, 88 exposing the thumbs 36, 38.

Mittens 68, 70 also include a plurality of pads 90, 92, 94, 98, 100, respectfully, located at various positions of mittens 68, 70. Pads 90-100 are configured to provide friction to enable a user to grip/grasp an article. In particular, pads 90, 92 are located on the palms of mittens 68, 70. Pads 94, 96 are located on the portion covering fingers 32, 34. Pads 98, 100 are located on the portion covering the thumbs 36, 38 of mittens 68, 70. These pads are shown in FIGS. 9-12. Pads 90-100 are preferably stitched to mittens 68, 70 but may be attached via glue or other means as known by those skilled in the art. While pads 90-100 are shown in the specific locations, those skilled in the art know that any number of pads may be used and at any number of locations on mittens 68, 70.

FIG. 10 depicts a detailed perspective view of wearable cover 10 in FIG. 1 in part, wherein mittens 68, 70 (hand coverings) are shown in open form, exposing fingers 32, 34 and thumbs 36, 38 during use. FIG. 11 depicts a cross-sectional view of mitten 68 (hand covering) of wearable cover 10 in FIG. 1 shown in a closed form. FIG. 12 depicts a cross-sectional view of mitten 68 (hand covering) of the wearable cover 10 in FIG. 1 shown in an open form.

Figure 13:
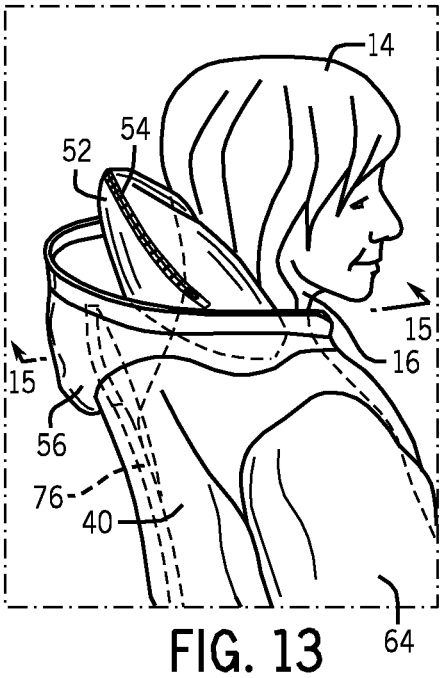
FIG. 13 depicts a detailed side perspective view of the wearable cover in FIG. 1, wherein the pouch is closed.
Figure 14:
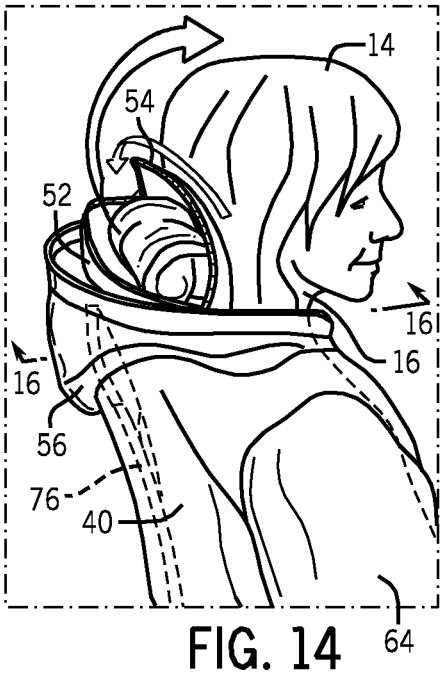
FIG. 14 depicts a detailed side perspective view of the wearable cover in FIG. 1, wherein the pouch is open.
Figure 15:
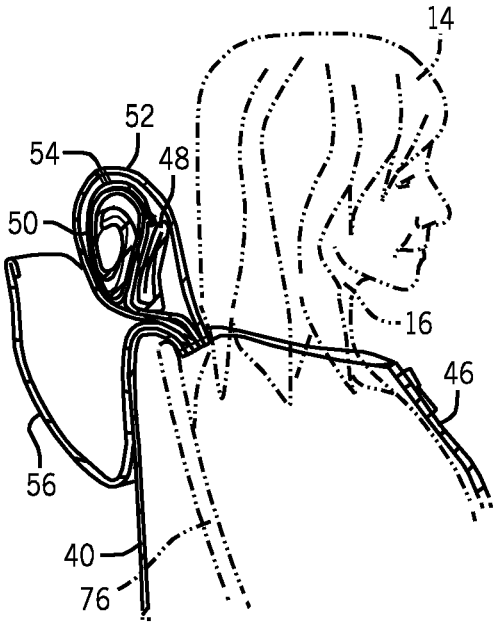
FIG. 15 depicts a detailed cross-sectional view of the wearable cover 10 in FIG. 13 taken along line 15-15.
Figure 16:
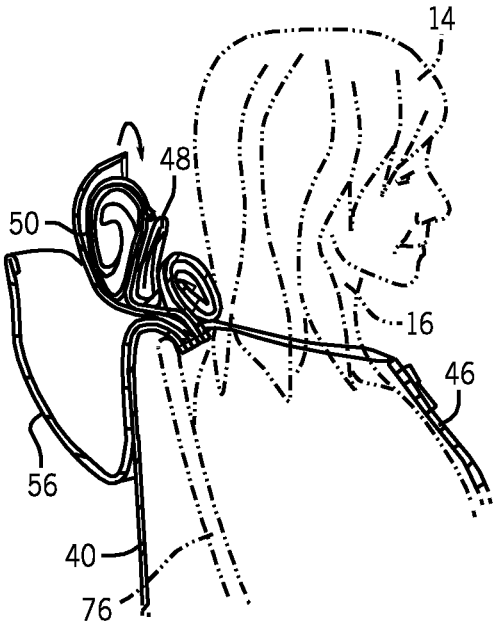
FIG. 16 depicts a detailed cross-sectional view of the wearable cover in FIG. 14 taken along line 16-16.

Reference is now made to FIGS. 13-16. FIG. 13 depicts a detailed side perspective view of wearable cover 10 in FIG. 1 wherein pouch 52 is zippered closed. As seen in FIG. 13 for example, pouch 52 is shown adjacent the rear of head 14 and it functions as a shield to protect user's neck 16 from weather. Hood 56 is in an un-deployed configuration. FIG. 14 depicts a detailed side perspective view of wearable cover 10 in FIG. 1 wherein pouch 52 is open. The portions within pouch 52 such as collar 48 and hat 50 remain in its compressed fitted form. The arrow adjacent head 14 illustrates the direction of zipper 54 movement as pouch 52 is opened. The other arrow illustrates the direction in which collar 48 and hat 50 must be unfolded, i.e., decompressed (unrolled) for deployment (use). FIG. 15 depicts a detailed cross-sectional view of the wearable cover 10 in FIG. 13 taken along line 15-15. FIG. 16 depicts a detailed cross-sectional view of the wearable cover in FIG. 14 taken along line 16-16.

Figure 17:
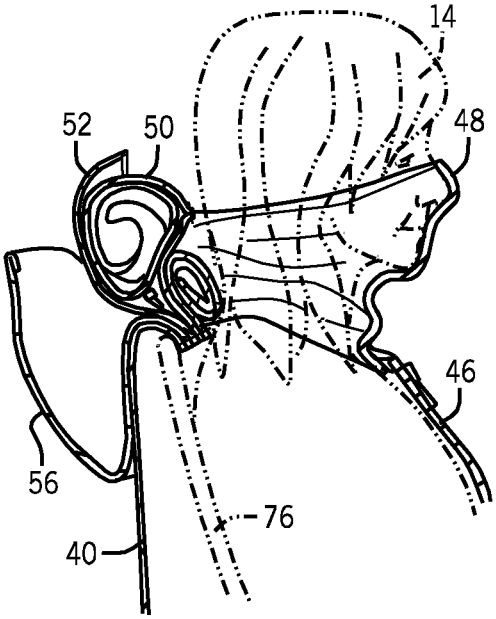
FIG. 17 depicts a detailed cross-sectional view of the wearable cover in FIG. 1, wherein the pouch is open and the collar is deployed over a user's head and fitted around the user's neck and face.
Figure 18:
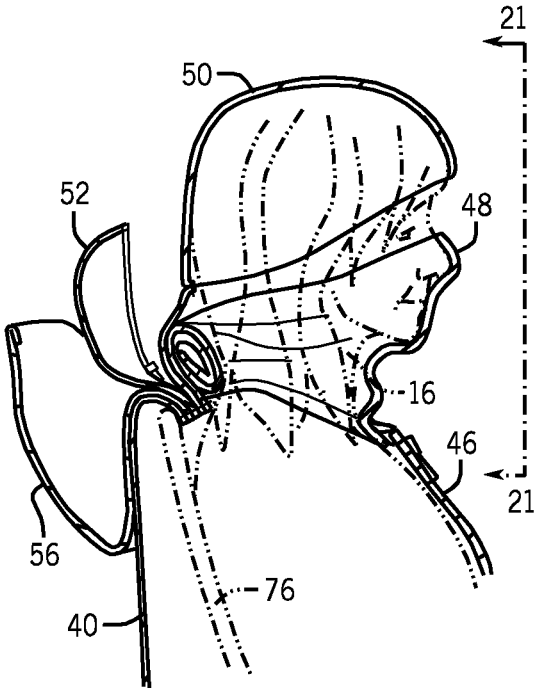
FIG. 18 depicts a detailed cross-sectional view of the wearable cover in FIG. 1, wherein the pouch is open, the collar and hat are deployed over the user's head and the collar is fitted around the user's neck and face (head) while the hat is fitted on the user's head.

Reference is made to FIGS. 17-20. FIG. 17 depicts a detailed cross-sectional view of the wearable cover 10 in FIG. 1, wherein pouch 52 is open and collar 48 is fitted over user's head 14 and around user's neck 16 and portion of head 14 (face). Hat 50 is fitted on user's head 14. Collar 48 is configured (by size and flexible material) to be manipulated by the user to cover and conform to user's face (head 14). FIG. 18 depicts a detailed cross-sectional view of the wearable cover in FIG. 1, wherein pouch 52 is open, collar 48 and hat 50 are deployed over user's head 14 and collar 48 is fitted around user's neck 16 and face (head 14) while hat 50 is fitted on user's head 14.

Figure 19:
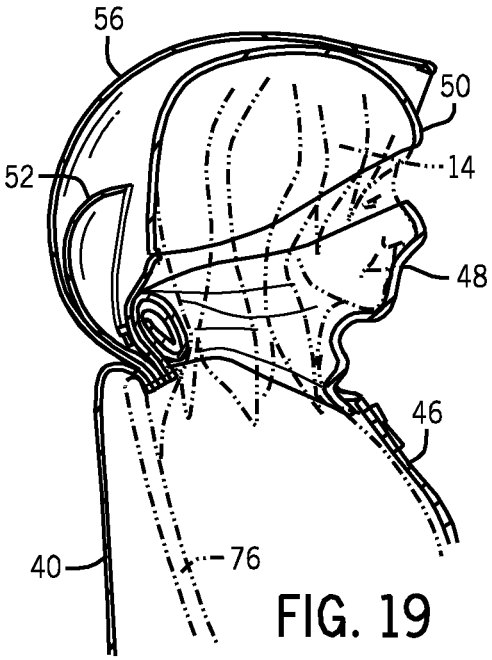
FIG. 19 depicts a detailed cross-sectional view of the wearable cover in FIG. 1, wherein the pouch is open, the collar and hat are deployed over the user's head and the collar is fitted around the user's neck and face (head), while the hat is fitted on the user's head 14 and hood is over the user's hat-covered head.
Figure 20:
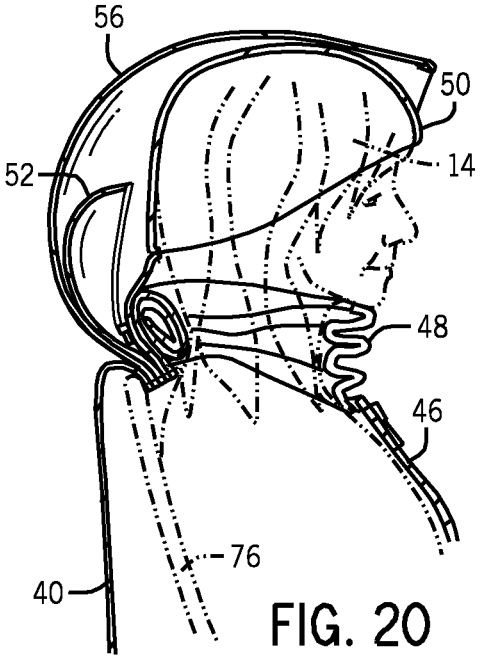
FIG. 20 depicts a detailed cross-sectional view of the wearable cover in FIG. 1, wherein the pouch is open, collar and hat are deployed over the user's head, and the collar is fitted over the user's neck (only), while the hood is over the user's head.

FIG. 19 depicts a detailed cross-sectional view of the wearable cover in FIG. 1, wherein pouch 52 is open, collar 48 and hat 50 are deployed over the user's head and the collar 48 is fitted around the user's neck and face (head), while hat 50 is fitted on the user's head 14 and hood 56 is over user's head 14. A user's view however is not obstructed because the wearable cover portions (i.e., collar and hat) do not cover the user's eyes. FIG. 20 depicts a detailed cross-sectional view of wearable cover 10 in FIG. 1, wherein pouch 52 is open, collar 48 and hat 50 are deployed over user's head 14, and collar 48 is fitted over the user's neck 16 (only), while hood 56 is over the user's head 14.

Figure 21:
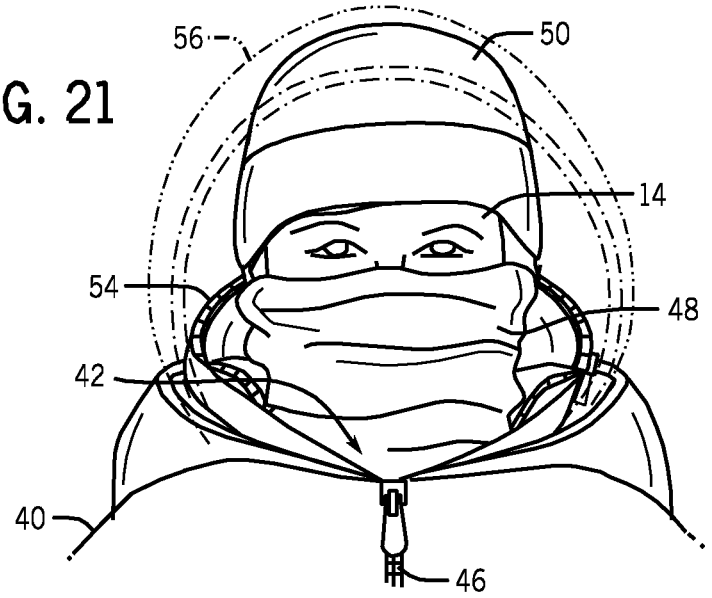
FIG. 21 depicts a detailed front perspective view of wearable cover in FIG. 18 taken along lines 21-21.
Figure 22:
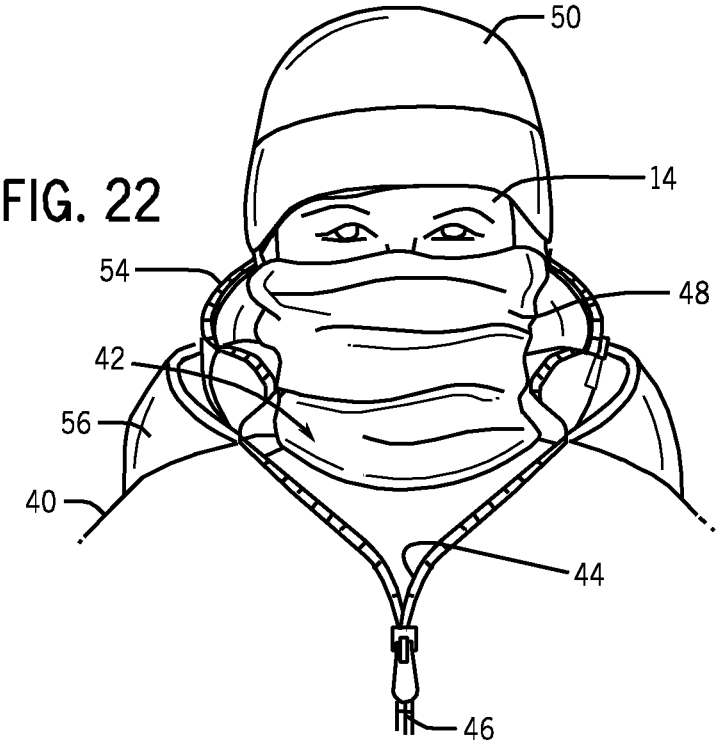
FIG. 22 depicts a detailed front perspective view of the wearable cover similar to that shown in FIG. 21.

As for FIGS. 21 and 22, FIG. 21 depicts a detailed front perspective view of wearable cover 10 in FIG. 18 taken along lines 21-21. FIG. 22 depicts a detailed front perspective view of the wearable cover similar to that shown in FIG. 21. However, pouch 52 is open, collar 48 is fitted around user's neck 16 and head 14 (face), and hat 50 is fitted on user's head 14. Additionally, zipper 46 is partially open, thus creating a gap between the attached collar and the body of the cover.

As indicated above, FIGS. 13-21 depict various implementations of wearable cover 10. In addition, hood 56 may be used alone with or without collar 48 or hat 50. For example, hood 56 may be used with hat 50 only or hood 56 may be used with collar 48 only. Alternatively, hat 50 may be used alone (without collar 48 or hood 56).

As described in detail above, wearable cover 10 may be used with or without a chair. For example, wearable cover 10 may be used by a spectator during a sporting event, by a newscaster, by a police officer (control crowd), by a weather reporter or by a trick-or-treating child. In yet another example, a child (user) may use wearable cover 10 while standing or may use it within a baby-stroller much like the chair identified above. In addition, an occupant of a stroller, car seat or wheel chair may use wearable cover 10. In the case of a wheel chair, wearable cover 10 will be configured to expand around the wheel chair in a tent-like structure to drape over the wheel chair leaving an air layer between wearable cover 10 and the user as known to those skilled in the art. In this example, the arms may or may not be employed as needed. These are just some examples of the applications of use of wearable cover 10. Those skilled in the art know that there are other uses for wearable cover 10.

As indicated above, wearable cover 10 is preferably constructed of variations of fleece and/or waterproof/water-resistant fabrics. However, wearable cover 10 may be constructed of fleece (in multiple grades or weights, layers, combinations, patterns), polyester, wool (and blends), silk, cotton, Gore-Tex or similar material, Kevlar, fake fur, or other cloths/materials or any combinations of these materials as known to those skilled in the art.

While wearable cover 10 is described for colder climates, it may be used in warmer climates. For example, wearable cover 10 may be constructed of other materials such as a mesh to enable a user to protect against pests (insects) that are a nuisance or a danger in warmer climates.

It is to be understood that the disclosure teaches examples of the illustrative embodiments and that many variations of the invention can easily be devised by those skilled in the art after reading this disclosure and that the scope of the present invention is to be determined by the claims below.

What is claimed is:

1. A wearable cover for covering a body of a user, the wearable cover comprising:

a main portion configured to cover a torso of the user's body, the main portion having an opening for enabling a head of the user's body to extend through the main portion; and a collar attached to a pouch, the collar configured to cover a neck of the user's body and a hat attached to the collar configured to cover a portion of the head, the pouch attached to the main portion adjacent the opening, wherein the collar and hat are configured to be compressed and fitted within the pouch.

2. The wearable cover of claim 1 wherein the collar is configured to deploy over the head of the user and settle in place over a neck of the user.

3. The wearable cover of claim 1 further comprising a hood attached to the main portion adjacent the opening.

4. The wearable cover of claim 1 wherein the main portion is further configured to cover one or more legs of a user's body.

5. The wearable cover of claim 4 wherein the main portion is configured to expand around a chair while the user is positioned within the chair and draped longitudinally while the user is standing.

6. The wearable cover of claim 1 wherein the collar is a turtle neck collar further configurable to cover the neck and portion of the head.

7. The wearable cover of claim 1 wherein the main portion includes an opening configured to enable an arm of the user's body to extend through the main portion, the wearable cover further comprising:

a sleeve attached to the main portion over the opening, the sleeve configured to cover an arm of the user's body; and a hand covering attached to the sleeve, the hand covering configured to cover the hand of a user.

8. The wearable cover of claim 7 wherein the hand covering includes a slit configured to enable a portion of the hand to extend through the hand covering.

9. The wearable cover of claim 7 wherein the hand covering comprises a mitten.

10. The wearable cover of claim 7 wherein the hand covering includes a pad configured to provide friction to enable a user to grasp an article.

11. The wearable cover of claim 1 wherein the main portion includes a slit extending along the main portion to enable user egress and ingress and a closure device configured to close the slit.

12. The wearable cover of claim 1 wherein the closure device comprises a zipper.

13. The wearable cover of claim 1 wherein the main portion includes a pocket configured to receive a hand of the user's body, the pocket defining an opening configured to enable an armrest of a chair to extend through the main portion.

14. The wearable cover of claim 13 wherein the pocket has a zipper for closing the opening.

15. A wearable cover for covering a body of a user, the wearable cover comprising:

a main portion configured to cover a torso of the user's body, the main portion having a first opening for enabling a head of the user's body to extend through the main portion and a second opening configured to enable an arm of the user's body to extend through the main portion;

a sleeve attached to the main portion over the second opening, the sleeve configured to cover an arm of the user's body;

the main portion includes a pocket configured to receive a hand of the user's body, the pocket further defining a pocket opening configured to enable an armrest of a chair to extend through the main portion, the pocket including a reversed configuration wherein the first pocket extends from the main portion; and, a hand covering attached to the sleeve, the hand covering configured to cover the hand of a user.

16. The wearable cover of claim 15 wherein the hand covering includes a slit configured to enable a portion of the hand to extend through the hand covering.

17. The wearable cover of claim 15 wherein the hand covering comprises a mitten.

18. The wearable cover of claim 15 wherein the hand covering includes a pad configured to provide friction to enable a user to grasp an article.

19. The wearable cover of claim 15 further comprising a collar attached to the main portion, the collar configured to cover a neck, a portion of a head or the neck and portion of the head of the user's body and a hat attached to the collar configured to cover a portion of the head.

20. The wearable cover of claim 19 further comprising a pouch attached to main portion adjacent the opening, wherein the collar and hat are configured to be compressed and fitted within the pouch.

21. The wearable cover of claim 15 further comprising a hood attached to the main portion adjacent the opening.

22. The wearable cover of claim 15 wherein the main portion is further configured to cover one or more legs of a user's body.

23. The wearable cover of claim 15 wherein the main portion is configured to expand around a chair while the user is positioned within the chair and to drape longitudinally while the user is standing.

24. A wearable cover for covering a body of a user, the wearable cover comprising:

a main portion configured to cover a torso of the user's body, the main portion having an opening for enabling a head of the user's body to extend through the main portion;

the main portion includes first and second sleeves, wherein the main portion includes first and second pockets configured to receive a hand of the user's body, the first and second pockets further defining pocket openings configured to enable an armrest of a chair to extend through the main portion; the first and second pockets including a reversed configuration wherein the first and second pockets extend from the main portion; and, a plurality of portions including (1) a collar attached to the main portion configured to cover a portion of the user's body and (2) a hat attached to the collar configured to cover a portion of the head.

25. The wearable cover for covering a body of a user according to claim 24, wherein the openings of the pockets are selectively closable.

26. The wearable cover for covering a body of a user according to claim 24, wherein the wearable cover is configured to drape completely over the chair when the user is seated in the chair, and wherein the wearable cover is configured to drape longitudinally to fully cover the user's legs when the user is standing.

27. The wearable cover for covering a body of a user according to claim 24, wherein the wearable cover envelops the user's body in a sitting position on the chair and in a standing position to fully cover the user's body.

* * * * *